United States Patent [19]

Barnes et al.

[11] 4,380,907

[45] Apr. 26, 1983

[54] METHOD OF BOILING LIQUEFIED GAS

[75] Inventors: Robert S. Barnes, Woking; Raymond Harper, Harlow, both of England

[73] Assignee: Cryoplants, Ltd., Edmonton, England

[21] Appl. No.: 281,737

[22] Filed: Jul. 9, 1981

[30] Foreign Application Priority Data

Jul. 14, 1980 [GB] United Kingdom ..... 8022934

[51] Int. Cl.[3] ..... F17C 7/02

[52] U.S. Cl. ..... 62/52; 165/40; 165/133

[58] Field of Search ..... 62/527, 52; 165/133, 165/140, 40

[56] References Cited

U.S. PATENT DOCUMENTS

| | | | |
|---|---|---|---|
| 3,012,408 | 12/1961 | Perkins et al. | 62/52 |
| 3,378,063 | 4/1968 | Mefford | 165/40 |
| 3,400,545 | 9/1968 | Hendal | 62/52 |
| 4,018,264 | 4/1977 | Albertson | 165/133 |
| 4,159,739 | 7/1979 | Brothers et al. | 165/133 |

*Primary Examiner*—Ronald C. Capossela

*Attorney, Agent, or Firm*—David L. Rae; Larry R. Cassett

[57] ABSTRACT

A method of boiling a liquefied gas in a heat exchanger 10 includes the step of introducing a seed gas via a pipeline 18 to spray nozzles 34 situated under passages 22 of the heat exchanger 10 for reboiling the liquefied gas, e.g. oxygen. The passages 22 alternate with passages 24 for condensing nitrogen vapor. The seed gas bubbles are trapped by cavities formed in the heat exchange surfaces where boiling of the oxygen takes place. Each cavity is of such a size and shape that the trapped bubbles grow until they break away from the cavity leaving residues of vapor therein sufficient to allow further gas to accummulate by evaporation until again bubbles break away.

5 Claims, 10 Drawing Figures

METHOD OF BOILING LIQUEFIED GAS

BACKGROUND OF THE INVENTION

This invention relates to a method of boiling liquefied gas in a heat exchanger (or the like) by heat exchange with another fluid, and to a heat exchanger for carrying out such boiling of liquefied gas. The invention also relates to a condenser-reboiler suitable for use in a rectification column in which a gas mixture, for example air, is separated.

In order to boil a liquefied gas it is necessary for the surface from which heat is transferred to the boiling liquid to be at a higher temperature than the liquid. It is known that the temperature differential "delta T" between the surface and the liquid required to effect boiling at a given rate is dependent on the nature of the surface: if the surface is smooth and planar the necessary temperature differential needs to be greater than if the surface is, for example, relatively rough. The reason for this phenomenon is apparently that, for example, a rough surface provides many more and better sites at which vapour bubbles can be nucleated than does a smooth, planar surface. Once a bubble is formed at the surface it grows to a radius sufficiently large for it to break away from the nucleating site, and either travels upwards along the surface or merges with another bubble at a nucleating site thereabout. As the bubbles travel upwards so they coalesce with other bubbles that lie in their path and the enlarged bubbles continue to move upwards.

It has therefore been proposed to form the heat transfer surfaces of heat exchangers for use in boiling liquefied gases with other than a smooth regular planar surface finish. For example, U.S. Pat. No. 3,301,314 discloses a heat transfer wall having formed therein a plurality of indentations of microscopic dimension whose depth is greater than their maximum width and which are partially filled with a deposit of a lower surface energy material, said material having a contact wetting angle with the liquid being boiled of at least 80°. Typically, the material of low surface energy is polytetrafluoroethelyene. U.S. Pat. No. 3,384,154 discloses bonding layers of porous material to the heat exchange surfaces of a heat exchanger. The pores, which are the size of capillaries, act as nucleation sites. It has also been proposed to roughen the heat exchanger surfaces of a heat exchanger by scratching such surfaces.

We believe, however, that there is a limit to the reduction in "delta T" that can be achieved merely by providing nucleation sites for the formation of bubbles. This is because once a bubble has grown to a size sufficiently large for its buoyancy to cause it to leave or "break away" from a nucleation site, further energy will be required to nucleate another bubble at that site.

In UK patent specification No. 1 304 861 there is described a heat conductive base member for transferring heat from a heat source on one side thereof to a boiling fluid on the other side thereof: a plurality of spaced apart fins having substantially smooth and uninterrupted side surfaces extending from said other side of said base member, each of said fins having a base portion joined to said base member and a tip portion bent over toward the next adjacent one of said fins to form a continuous gap between said tip portion and said one fin, said gaps having a width from 0.001 to 0.005 inches, the gap between said tip portion and said next adjacent one of said fins being less than the space between the respective base portions of adjacent fins whereby a continuous re-entrant shaped cavity is formed between adjacent ones of said fins.

In use, superheated liquid is trapped between the fins, and forms bubbles. The bubbles grow in size until their buoyancy is sufficient to overcome the surface tension at the tips of the fins when the bubbles will break away. A substantial mass of vapour remains within the elongate cavities between the fins and liquid enters the cavity to take the place of the space occupied by the vapour that has "broken" away in the form of bubbles. The incoming liquid displaces the vapour along the groove such that new bubbles form at different sites.

In U.S. Pat. No. Re. 30,077 there is described a heat exchange wall having a boiling surface layer formed thereon with a plurality of cavities. The cavities are adapted to entrap vapour bubbles within the boiling surface layer to provide boiling nucleation sites.

Each cavity is open to the boiling surface layer through a restricted opening which has a cross-sectional area smaller than the largest cross-sectional area in the cavity interior. The opening provides egress for vapour from the interior of the cavity to the boiling surface layer during boiling.

SUMMARY OF THE INVENTION

According to one aspect of the present invention there is provided a method of boiling a liquefied gas in a heat exchanger (or the like) by heat exchange with another fluid, in which boiling is promoted by introducing bubbles of gas into the heat exchanger and trapping such bubbles in cavities in heat exchange surfaces in the region of the heat exchanger where boiling takes place, the cavities being of such a shape and size that the trapped bubbles are able to grow until they break away from the cavities leaving residues of vapour therein sufficient to allow further gas to accumulate by evaporation until again bubbles break away.

In order to perform the method, the invention also provides a heat exchanger for boiling a liquefied gas by heat exchange with another fluid, having means for introducing bubbles of gas into heat exchange passages, heat exchange surfaces of such passages having, in the region where, in use, boiling takes place cavities of such a shape and size that, in use, bubbles are trapped and the trapped bubbles are able to grow until they break away from the cavities leaving residues of vapour therein sufficient to allow further gas to accumulate by evaporation until again bubbles break away.

The method and apparatus according to the invention makes it possible to avoid wasting energy in nucleating bubbles at a site where there is no subsisting vapour.

Once the cavities have been primed with bubbles of "seeding" gas, it will typically be unnecessary to continue to supply this gas. Moreover, once the bubbles of the seeding gas have been trapped the difference in temperature between the heat exchanges surfaces and the liquid will tend to decrease. This temperature difference may be used to control the introduction of seeding bubbles. Accordingly, a parameter or parameters related to the difference in temperature between the boiling liquefied gas and the heat exchange surfaces, or the temperature difference itself, may be monitored, and the introduction of the "seed" bubbles into the liquefied gas is controlled such that bubbles are introduced only during periods in the temperature difference between the heat exchange surfaces and the liquefied gas is above a chosen value. Thus, means for monitoring the parameter or parameters related to the difference in temperature between the boiling liquefied gas and the adjacent heat exchange surfaces (or the temperature difference itself) and a valve controlling flow of gas to the bubble introduction means may be provided, the valve being operatively associated with the monitoring means such that, in operation, the bubbles of gas are introduced only when desired.

The heat exchanger may function as a condenser-reboiler for use in the rectification of air.

The heat exchanger is preferably of the plate-and-fin type.

If the heat exchanger is to be used to condense a gas or vapour in addition to boiling a liquefied gas, the pressure of the incoming gas or vapour for condensation and the pressure of the vapour of the boiling liquid may both be monitored and means responsive to the monitored values of such pressures employed to control a valve through which "seeding gas" is passed to the introduction means. The two pressures will be directly related to the temperatures of the respective fluids and, accordingly, the difference between the pressures provides a measure of the temperature difference between heat exchanging streams and hence of the efficiency of heat transfer from one fluid to the other. Alternatively, if desired, the temperature of the vapour of the boiling liquid leaving the heat exchanger and the temperature of the incoming fluid may be measured directly by means of thermocouples or other temperature sensors.

The seeding bubbles owing to their buoyancy ascend the heat exchange passages into which they are introduced. As the bubbles rise so they steadily diminish in size as a result of condensation of some of the vapour they contain. However, while this is happening the bubbles will be rising through zones each with higher temperatures.

Once the temperature exceeds the boiling temperature the vapour will begin to accumulate and the bubbles increase in size. Some of the bubbles are trapped in the cavities and remain there until they grow large enough to break away.

There is a considerable tolerance as to the dimensions of the cavities. It is to be emphasised however that the cavities are large enough in size to enable them to retain sufficient vapour when a bubble breaks away. There is a critical bubble radius dependent on "delta T" above which the vapour accumulates and the bubbles will grow. For example, we believe that for oxygen the critical radius is in the order of 0.005 cm if delta T is 0.1° C. The cavities may, however, conform to any one of a large number of shapes and sizes. In one example, there is a sufficient volume above the level of the entrance to each cavity to maintain a bubble whose radius is greater than the critical radius.

The trapped bubbles will accumulate vapour from adjacent liquid and thus grow in size until their radius is such that they break away from the respective cavities. Typically, for oxygen, we believe this break away radius is in the order of 0.1 cm. The mouth of each cavity may, for example, have a radius, or if it is not circular, a width or length less than 0.1 cm.

Once as a bubble breaks away it will travel upwards and sweep away others of smaller radius in its path. In travelling upwards there will be an enhanced flow of liquid over the adjacent heat transfer surface, thus increasing local heat transfer. In order to give adequate "sweeping" of the surface we believe that if it desirable for there to be more than five separate cavities per square centimeter of the heat exchange surface (excluding fins if a plate-and-fin heat exchanger is employed) in the boiling zone. Preferably, there are from 5 to 10 separate cavities per square centimeter.

It is possible to form the cavities by conventional metal forming techniques. It is not necessary to form the cavities with an oblique axis to the surface of the heat exchange surface. If desired, the cavity may have an axis perpendicular to the plane of the surface, and the surface, in use, is tilted at an angle to the vertical so as to dispose each cavity at an angle such that there is an adequate volume in it above its mouth.

It is not necessary for the "seeding" gas to be of the same composition as the liquid being boiled. In some instances, it might be desirable to use a gas which has a boiling point well below the prevailing temperatures in the heat exchanger.

BRIEF DESCRIPTION OF DRAWINGS

A method and heat exchanger according to the invention will now be described by way of example with reference to the accompanying drawings, in which.

DESCRIPTION OF PREFERRED EMBODIMENT

Figure 1:
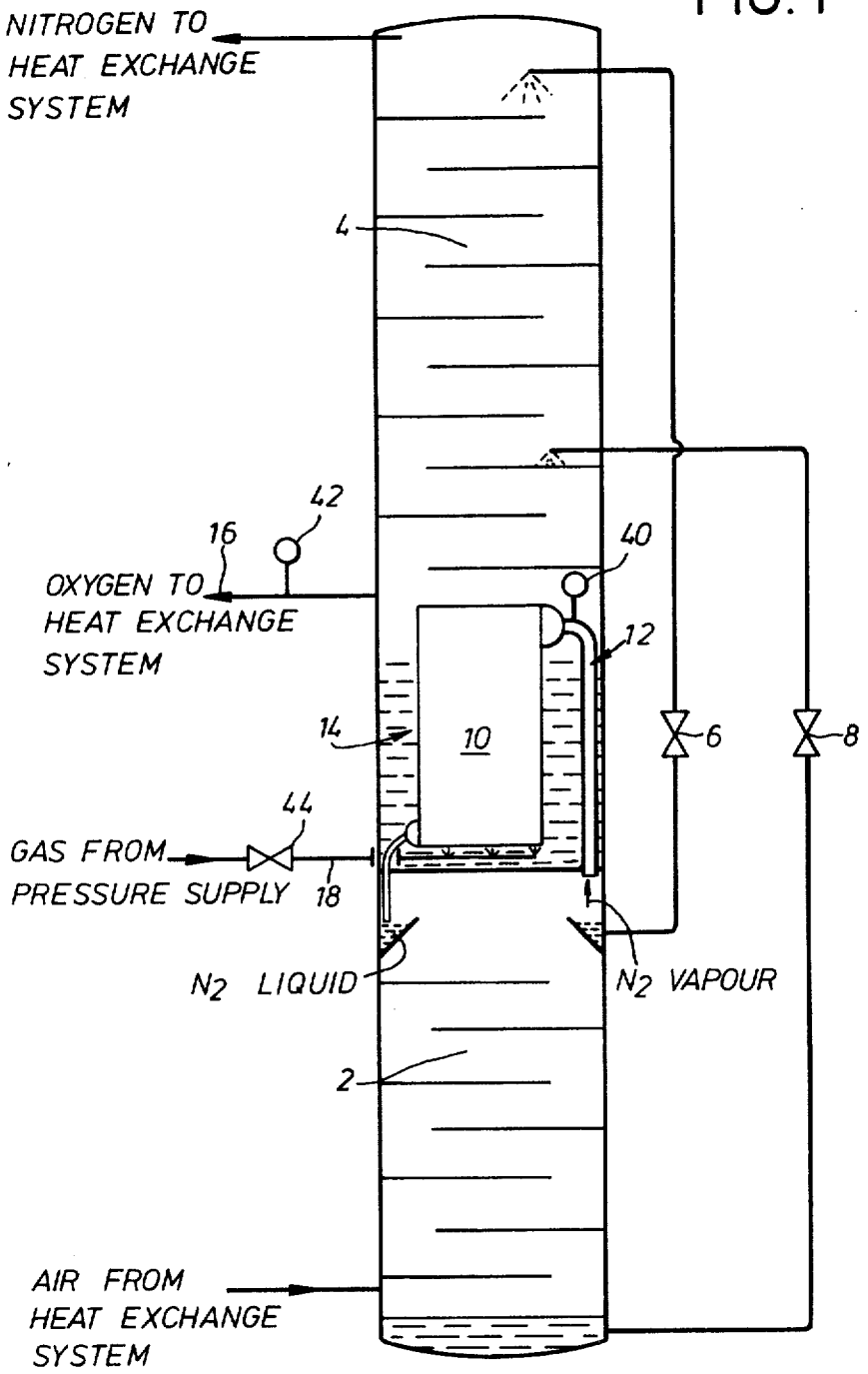
FIG. 1 is a schematic diagram of a double rectification column for use in separating air.
Figure 2:
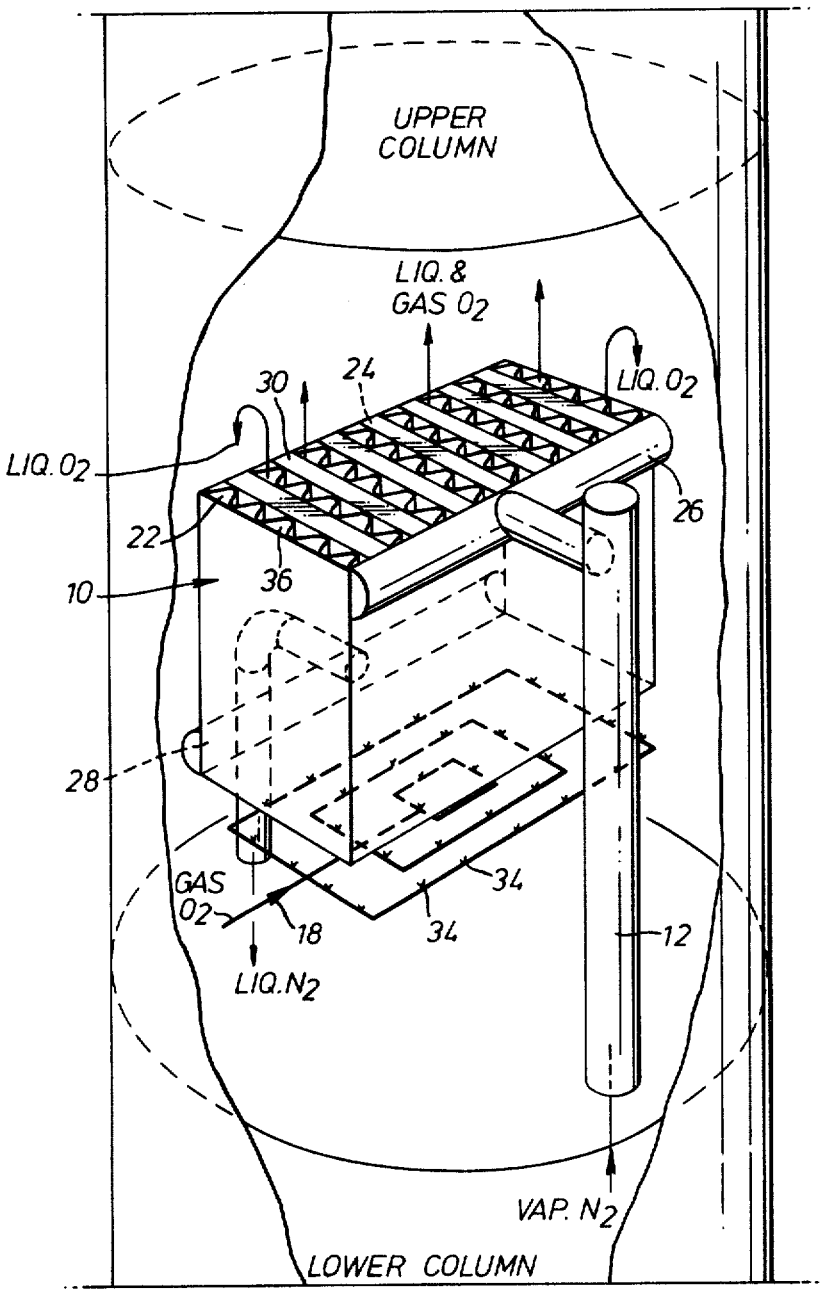
FIG. 2 is a schematic view of the condenser-reboiler shown in FIG. 1.
Figure 3:
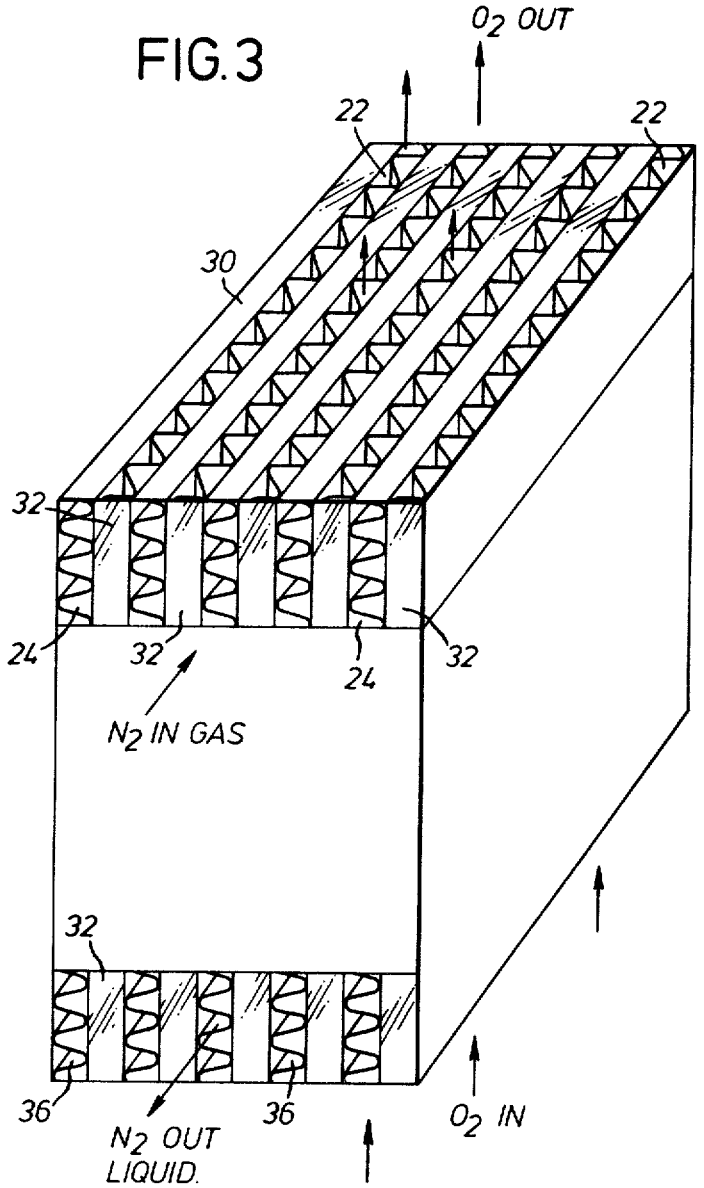
FIG. 3 is a schematic representation of the heat exchanges passages shown in FIG. 2.
Figure 4:
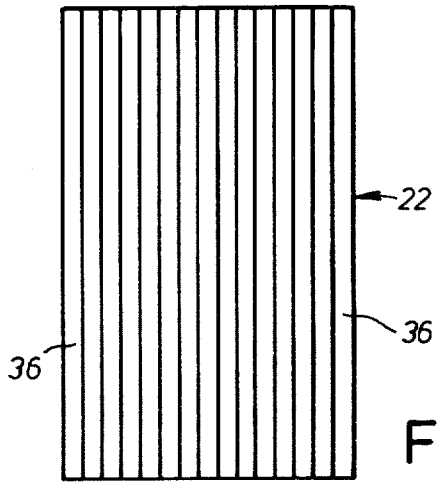
FIG. 4 is a section through an oxygen passage of the condenser-reboiler.
Figure 5:
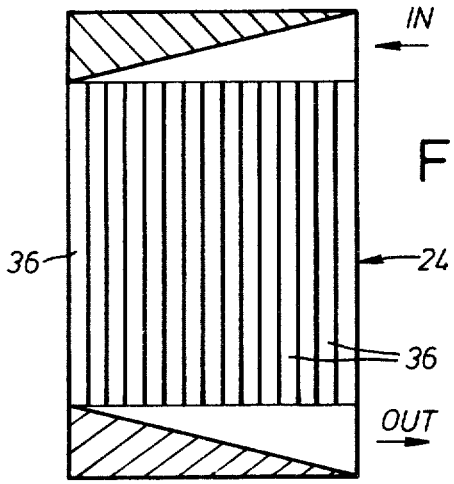
FIG. 5 is a section through a nitrogen passage of the condenser-reboiler shown in FIG. 2.
Figure 6A:
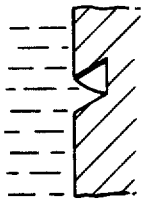
FIG. 6 is a schematic drawing illustrating a single cavity in a heat exchange surface of the condenser-reboiler shown in FIGS. 2 to 6.
Figure 6B:
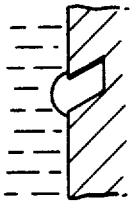
Figure 6C:
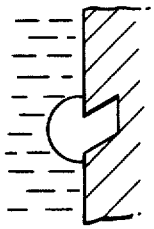
Figure 6D:
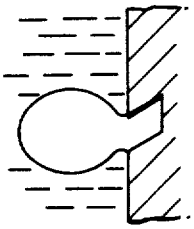
Figure 6E:
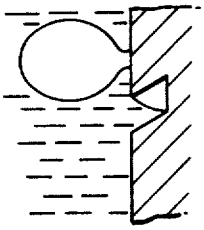

Referring to FIG. 1 of the accompanying drawings, there is shown a double rectification column for use in separating air. The double column comprises a low pressure column 4 superimposed upon a high pressure column 2. Incoming cold air is introduced into the high pressure column 2 and is separated into relatively pure liquid nitrogen at the top, and oxygen-rich liquid at the base. Part of the liquid nitrogen is expanded through a valve 6 to the top of the upper column as reflux and the remainder used as reflux in the lower column, whilst the oxygen-rich liquid is expanded through a valve 8 and fed to an intermediate point in the upper column. Oxygen is withdrawn from the base of the upper column and substantially pure nitrogen from the top. The pressure in the upper column is that required to drive the oxygen and nitrogen products through the heat exchangers in which the incoming air is cooled, and is usually in the range 1 to 2 atmospheres. The pressure in the lower column is that required to condense the nitrogen with oxygen boiling in the base of the upper column.

Condensation of nitrogen vapour collecting at the top of the high pressure column 2 and reboiling of liquid oxygen collecting at the bottom of the upper column 4 are effected by a condenser-reboiler 10 intermediate the two columns. The nitrogen feed for the condenser-reboiler is provided by a pipeline 12 in communication with the top of the lower column 2 and the liquid oxygen feed for the condenser-reboiler 10 comes from a liquid oxygen sump 14 in which the condenser-reboiler is partially immersed. The head of the liquid oxygen is effective to provide a satisfactory flow rate of oxygen through the condenser-reboiler 10 by a thermosiphon action.

In accordance with the invention, some gas under pressure is introduced through the pipeline 18 to the bottom of the oxygen passages of the condenser-reboiler 10. It is to be appreciated that only a very small proportion of the gas will be required to be introduced in this way.

Referring to FIGS. 2 to 5 the condenser-reboiler 10 is of the plate-and-fin type. It has passages 22 for reboiling oxygen alternating with passages 24 for condensing nitrogen vapour. Nitrogen vapour is distributed to the tops of the nitrogen passages through a header 26 and liquid nitrogen product is taken from the bottom of the nitrogen passages through a header 28. The oxygen passages are open at the bottom of the condenser-reboiler 10 to the liquid oxygen and at the top of the condenser-reboiler terminate above the level of the liquid oxygen to allow oxygen vapour vaporised in the passages to be taken from the upper column as product.

The nitrogen passages are formed at their tops and bottoms with solid members 30 to prevent the nitrogen becoming mixed with oxygen. Analogously, the oxygen passages formed with solid members 32 at their sides to prevent the oxygen becoming mixed with the nitrogen. (See FIGS. 3 to 5).

Spaced just below the bottom of the passages of the condenser-reboiler 10 is a plurality of nozzles 34 all communicating with a pipeline 18. In operation, bubbles of oxygen can be introduced by the nozzles 34 into the oxygen passages to promote boiling.

Referring again to FIG. 1, the pressure of nitrogen entering the top of the condenser-reboiler is measured by means of a pressure gauge 40 and the pressure of the vaporised oxygen is measured by a pressure gauge 42. In addition, a valve 44 is disposed in the pipe 18. The valve is operatively associated with the pressure gauges 40 and 42 such that it is open only when the pressure difference therebetween is above a chosen value.

In operation, the bubbles of gas (typically oxygen) are introduced from the spray nozzles 34 into the bottom of the oxygen passing upwardly (by the action of siphoning) through the passages 22. As it ascends the passages 22 so the temperature of the liquid oxygen is raised until the boiling point is exceeded. The necessary heat for raising the temperature of the oxygen is provided by the nitrogen vapour passing through the passages 24 countercurrently to the oxygen. The heat is conducted from the nitrogen to the oxygen by means of the plate and fin heat exchange surfaces. In order to effect boiling it is necessary that the temperature of the heat exchange surface be above the boiling point of the liquid oxygen. The necessary temperature difference depends on the efficiency of the heat transfer from the surfaces to the liquid oxygen.

The surfaces of the plates defining the oxygen passages are formed with cavities, one of which is shown schematically in FIG. 6. Typically, there are five to ten cavities per square centimeter of plate surface.

If this temperature differential ("delta T") is excessive as it typically will be before the bubbles of oxygen gas are introduced into the bottom of the passages 22, this will be indicated by the difference in the pressure readings of the gauges 40 and 42. In such circumstances, the valve 44 will be open and gas will be passed under pressure into the spray nozzles 34 and distributed as bubbles to the bottom of the heat exchange passages 22. At least some of the gas bubbles so introduced drift to the heat exchange surfaces in the boiling zone and are trapped in the cavities. A trapped bubble accumulates oxygen vapour and thus grows in size until its radius is such that it starts to protrude out of the cavity. It continues to grow until its radius is such that buoyancy overcomes the surface tension and causes the bubble to break away from the heat exchange surface leaving a residue of vapour sufficient to allow further gas to accumulate by evaporation of the liquid oxygen until again bubbles break away and sweep up the heat exchange surface. Thus, introduction of the bubbles into the heat exchange passages 22 through the nozzles 34 facilitates the formation of further bubbles and thereby reduces the thermal energy needed to be supplied from the plate-and-fin heat exchanger surfaces for this purpose. Accordingly, the temperature difference between the light oxygen and the heat exchange surfaces will fail and there will be a concomittant reduction in the pressure difference between the oxygen pressure and the nitrogen pressure as indicated by the gauges 40 and 42. This in turn will lead to the valve 44 closing and thus the supply of seeding bubbles will stop. However, this should not in itself cause any substantial increase in the thermal energy required to promote boiling of the liquid oxygen. This is because vapour remaining in the cavities at a heat exchange surface are self-renewing in that they tend to leave a residual volume of vapour sufficient to form a new bubble.

The various stages in the growth of a bubble are shown in FIG. 6.

We claim:

1. A method of boiling a liquefied gas in a heat exchanger having cavities formed in heat exchange surfaces comprising the steps of:

(a) passing another fluid into said heat exchanger in indirect heat exchange relation with said liquefied gas to thereby supply thermal energy to said liquefied gas;

(b) introducing bubbles of a seeding gas into the liquefied gas in the heat exchanger;

(c) trapping at least some of said bubbles of seeding gas in said cavities; and (d) retaining said trapped bubbles in said cavities until said bubbles increase to a size such that said bubbles break away from said cavities while leaving a sufficient residue of vapors of the liquefied gas in the cavities to enable further bubbles to form therein by boiling of said liquefied gas.

2. The method defined in claim 1 additionally comprising the steps of monitoring the temperature difference between the temperatures of said boiling liquefied gas and said heat exchange surfaces, and interrupting the introduction of said bubbles of seeding gas while said monitored temperature difference is below a predetermined value.

3. The method defined in claim 1 wherein said fluid is a vapor and additionally comprising the step of condensing said vapor in said heat exchanger while said liquefied gas is boiled.

4. The method defined in claim 3 additionally comprising the steps of monitoring (1) the pressure of vapor of said liquefied gas in said heat exchanger and (2) the pressure of said vapor which is condensed in said heat exchanger, and interrupting the introduction of said seeding gas upon the difference between said pressures exceeding a predetermined value.

5. The method defined in claim 1 wherein said step of introducing bubbles of said seeding gas comprises injecting bubbles into said liquefied gas prior to passing said liquefied gas and said bubbles into said heat exchanger.

* * * * *